US005181857A

United States Patent [19]

Layser

[11] Patent Number: 5,181,857

[45] Date of Patent: Jan. 26, 1993

[54] LATCH MECHANISM FOR A HEADER

[75] Inventor: Steven M. Layser, Lebanon, Pa.

[73] Assignee: AMP Incorporated, Harrisburg, Pa.

[21] Appl. No.: 854,383

[22] Filed: Mar. 19, 1992

[51] Int. Cl.[5] ..... H01R 13/62

[52] U.S. Cl. ..... 439/157; 439/153

[58] Field of Search ..... 439/152-160, 439/372, 352, 353

[56] References Cited

U.S. PATENT DOCUMENTS

| | | | |
|---|---|---|---|
| 4,178,051 | 12/1979 | Kocher et al. | 339/45 M |
| 4,232,926 | 11/1980 | Inouye et al. | 439/157 |
| 4,448,471 | 5/1984 | Berry et al. | 339/91 R |
| 4,579,408 | 4/1986 | Sasaki | 439/157 |
| 4,773,881 | 9/1988 | Adams, III | 439/681 |
| 5,070,529 | 12/1991 | Beaufort et al. | 439/160 |
| 5,108,298 | 4/1992 | Simmel | 439/160 |

*Primary Examiner*—David L. Pirlot

[57] ABSTRACT

A latch mechanism (4) of an electrical header (1) comprises, a lever member (5) pivotally mounted on an end of the header (1) and being adapted for close spacing from a similar lever member (5) of a second electrical header (1), the lever member (5) being adapted to nest against an exterior of the similar lever member (5), and an actuation arm (10) pivotal with the lever member (5) to overlap the similar lever member (5), a reinforcing rib extending beside the arm (10), and a gripping surface (11) along the arm (10).

4 Claims, 4 Drawing Sheets

LATCH MECHANISM FOR A HEADER

FIELD OF THE INVENTION

The invention pertains to a latch mechanism for an electrical header, and especially to a latch mechanism that is adapted to pivot outwardly from the header.

BACKGROUND OF THE INVENTION

A latch mechanism for an electrical header is known from U.S. Pat. No. 4,178,051, and comprises a lever member pivotally mounted on each end of a header. The latch mechanism comprises a latching arm with a shoulder for engaging and retaining an electrical connector that is connected to the header. The latch mechanism further comprises an actuation arm against which a force is applied to pivot the lever member, causing the lever member to disengage from the electrical connector. Thereby, the electrical connector is no longer retained by the latch mechanism.

The latch mechanism of U.S. Pat. No. 4,178,051, further comprises an eject lever that is pivoted to push the electrical connector, causing ejection of the electrical connector. A header with an eject lever is known as a latch eject header.

SUMMARY OF THE INVENTION

The invention is useful in a latch mechanism for an electrical header, whether or not the latch mechanism comprises an eject lever. When a latch mechanism is pivoted, it will project outwardly of an end of the header. A clearance space has been required to provide room for pivoting the latch. It would be desirable to eliminate or at least reduce the clearance space. For example, multiple headers are often utilized in close proximity to one another. By reducing the clearance space to a minimum, a more compact use of multiple headers would be achieved.

The invention resides in a latch mechanism that is adapted to pivot outwardly of a header, and to nest against a similar latch mechanism of a similar header, allowing substantial reduction of a clearance space heretofore required to provide room for pivoting the latch.

Further the invention resides in a projecting actuation arm of the latch mechanism adapted to overlap the similar latch mechanism. Such an arm is adapted with a gripping surface for receiving the application of a force to pivot the latch mechanism, and a reinforcing rib.

DETAILED DESCRIPTION

Figure 1:
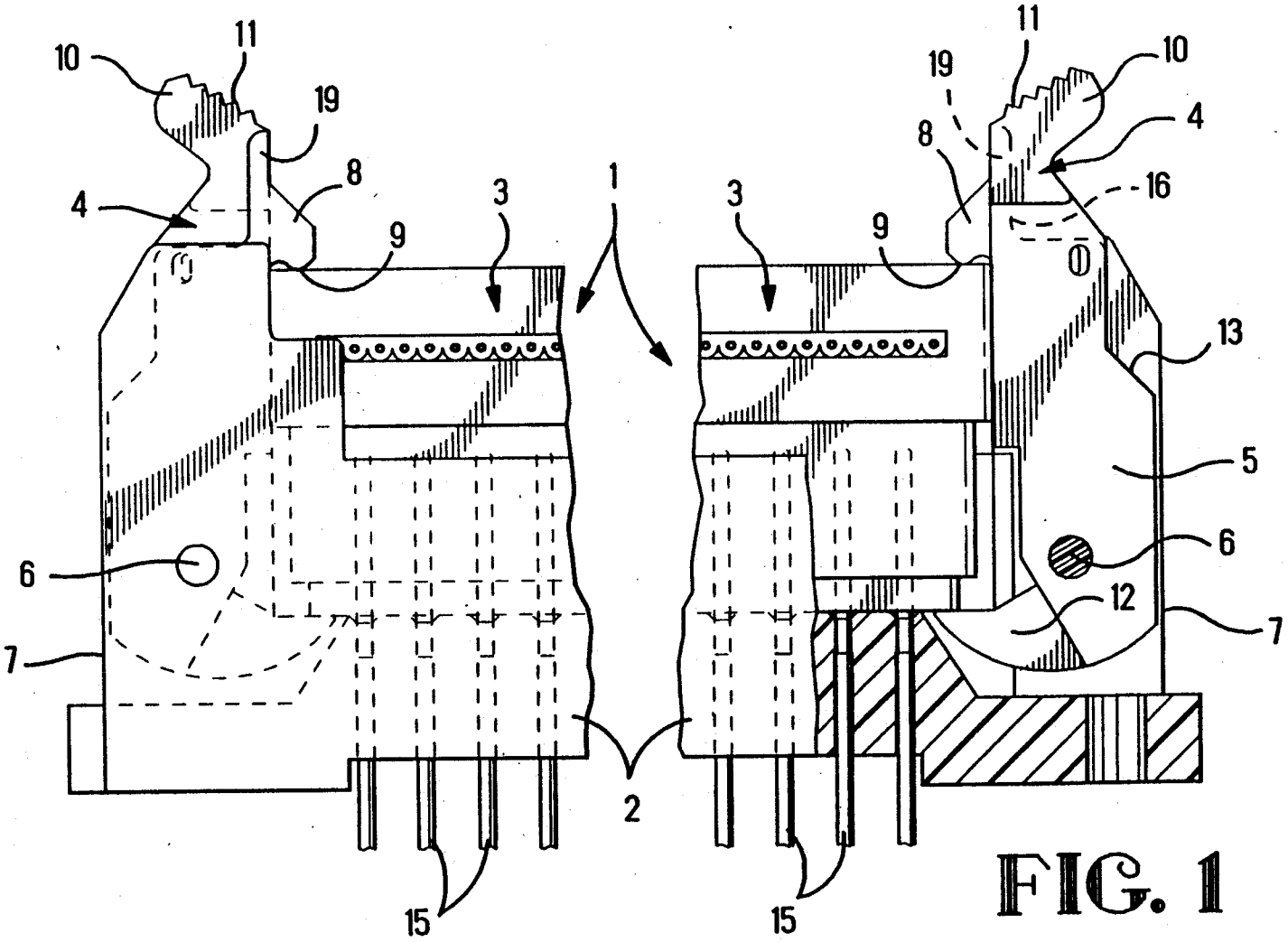
FIG. 1 is a fragmentary elevation of a header with a latch mechanism.
Figure 3:
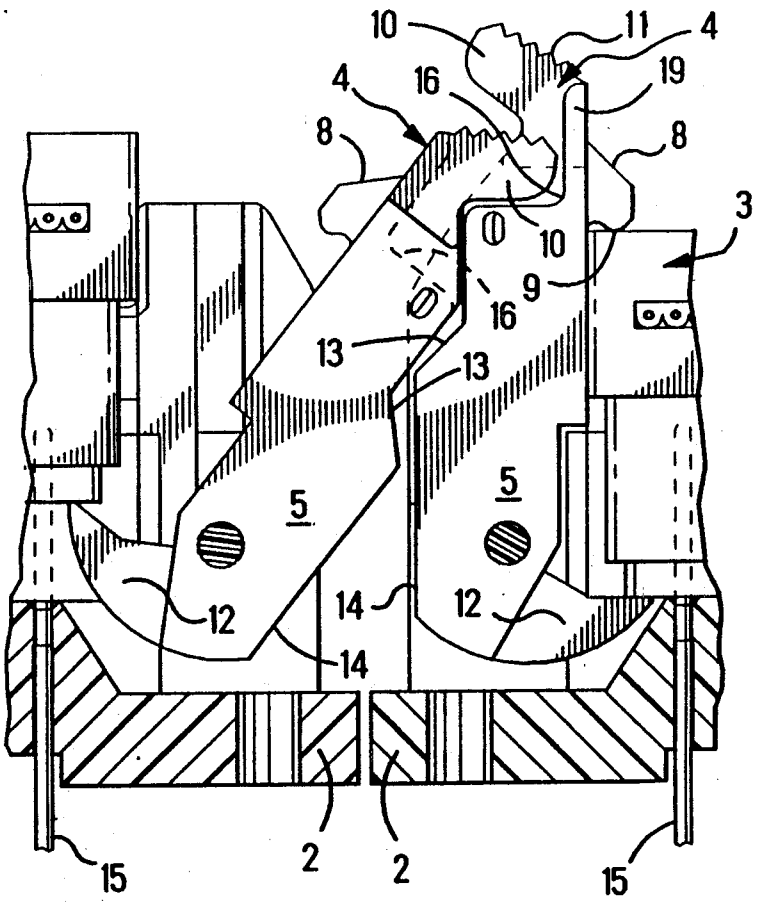
FIG. 3 is a view similar to FIG. 2 with two latch mechanisms nested.
Figure 2:
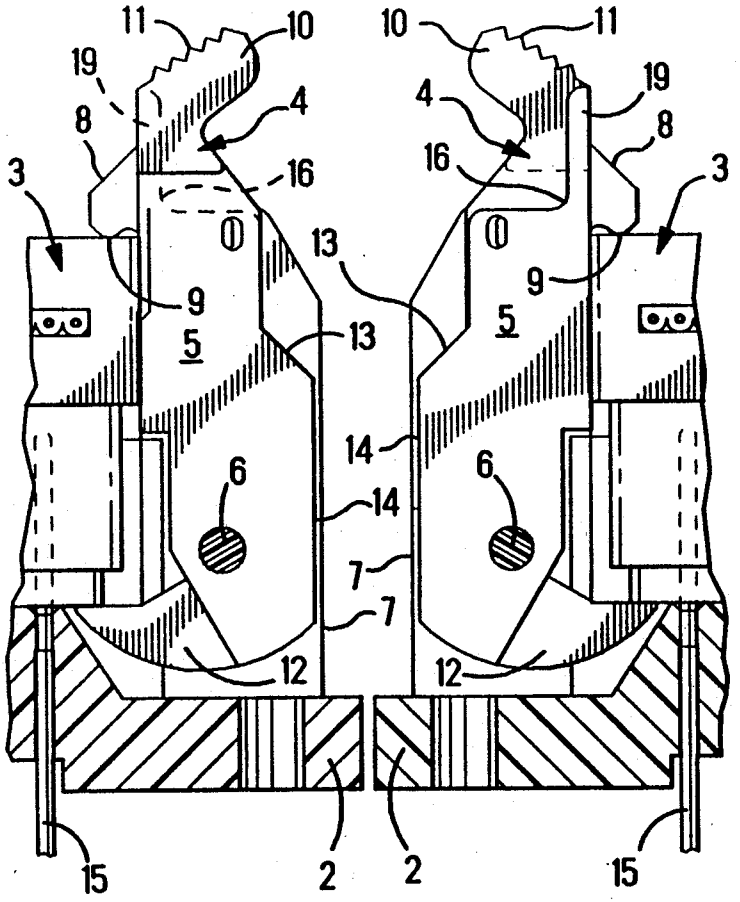
FIG. 2 is a fragmentary elevation view of two headers.
Figure 5:
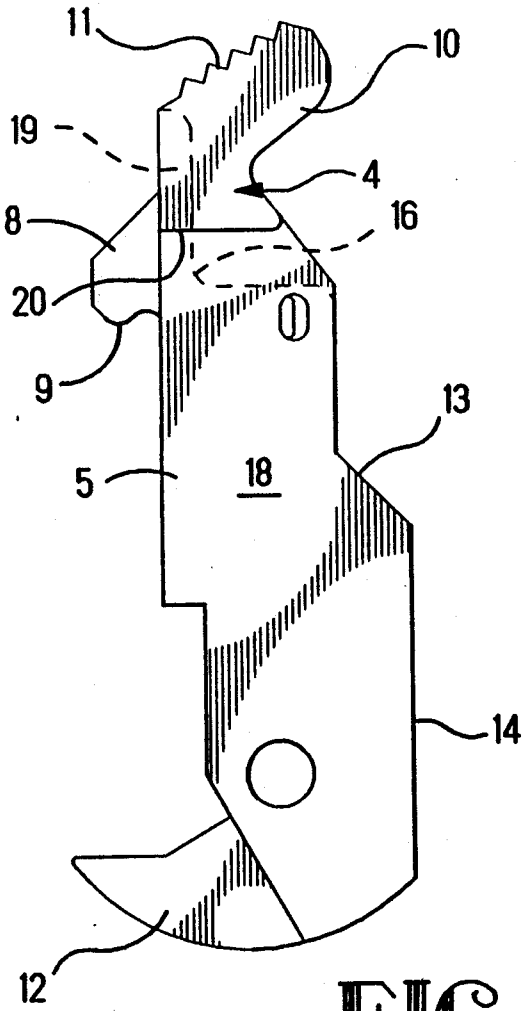
FIG. 5 is a front elevation view of the latch mechanism.
Figure 4:
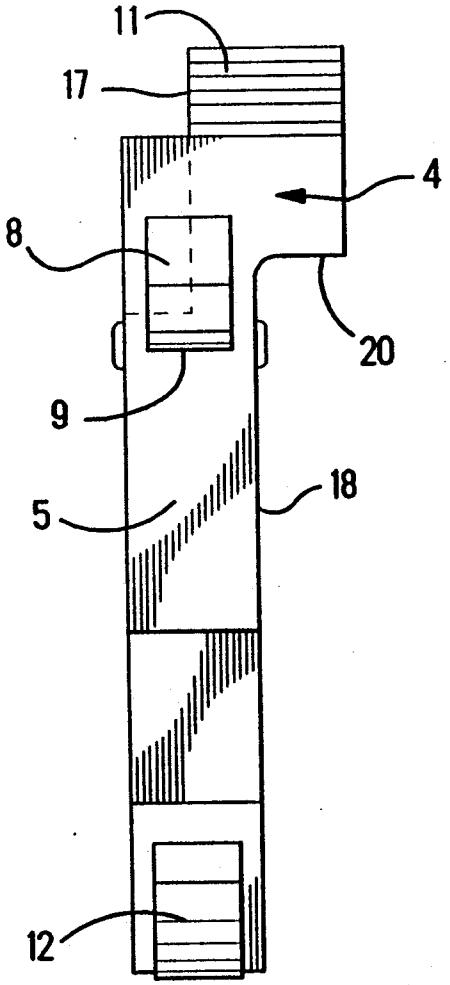
FIG. 4 is a side elevation view of a latch mechanism.

With reference to the drawings, an electrical header 1 comprises a housing 2, electrical terminal pins 15 in the housing 2, and the housing 2 being adapted for receiving an electrical device 3, such as, an electrical connector disclosed in U.S. Pat. No. 4,178,051, or such as, a circuit card, not shown. Further details of the header 1 are disclosed, for example, in U.S. Pat. No. 4,178,051.

A latch mechanism 4 of the electrical header 1 includes a lever member 5 pivotally mounted by a pivot pin 6 on an end 7 of the header 1. The pin 6 provides a pivot for the latch mechanism 4. Opposite ends 7 of the header 1 are provided with a pivotally mounted latch mechanism 4, although the description herein describes one latch mechanism 4 at one end 7.

A latching arm 8 is on the lever member 5 with a shoulder 9 adapted to engage an electrical device 3 mated to the header 1. An actuation arm 10 is on the lever member 5. The actuation arm 10 projects from the lever member 5, and is adapted to receive the application of a force to pivot the latching arm 8 in a direction outwardly of the header 1 to disengage the shoulder 9 of the latching arm 8 from the electrical device 3. A gripping surface 11 is on the actuation arm 10 to facilitate a firm grip when a person's finger applies a force to the gripping surface 11 to pivot the lever member 5 and the latching arm 8 in a direction outwardly of the header 1 to disengage the latching arm 8 from the electrical device 3.

When the latching arm 8 is thus disengaged, the electrical device 3 can be removed from the header 1. In one type of header 1, the electrical device 3 is ejected by an eject lever 12 attached to the lever member 5. The eject lever 12 extends outwardly from the pivot pin 6 and is adapted to be engaged by an electrical device 3 inserted into the header 1. The eject lever 12 is on the lever member 5. Pivoting of the lever member 5 in a direction outwardly of the header 1 will pivot the eject lever 12. The eject lever 12 when pivoted will urge against the electrical device 3, and will lift the electrical device 3 and, thereby, eject the electrical device 3. In another type of header 1, not shown, the eject lever 12 is absent, so that, after pivoting of the lever member 5 to disengage the latching arm 8 from the electrical device 3, the electrical device 3 must be removed from the header 1 by manual effort.

When two headers 1 are grouped together closely, end 7 to end 7, the lever member 5 of one header 1 is adapted to nest against an exterior of the similar lever member 5 of the other header 1. For example, a first recess 13 along a side 14 of the lever member 5 faces outwardly of the header 1 toward the similar lever member 5. A second recess 16 in the same side 14 is adjacent to the first recess 13, and is beside the actuation arm 10. When either lever member 5 is pivoted, the lever member 5 nests against the similarly shaped exterior of the similar lever member 5. An outermost end of the lever member 5 is farthest from the pivot pin 6, and will be displaced the farthest distance when the lever member 5 is pivoted. The second recess 16 is farther from the pivot pin 6 than the first recess 13. The second recess 16 is more deeply recessed than the first recess 13 to receive and to nest the end of a pivoted, similar lever member 5. The first recess 13 is less deeply recessed to receive and to nest a portion of the similar lever member 5 that is displaced a shorter distance when the similar lever member 5 is pivoted.

The actuation arm 10 is offset at 17 to one side 18 of the lever member 5 so as to be offset from the recess 16. The actuation arm 10 provides an overhang 20 projecting from the side 18. The actuation arm 10 is offset from a similar actuation arm 10 of the similar lever member 5. The actuation arm 10 is pivoted with the lever member 5 to reside alongside the actuation arm 10 of the similar lever member 5, and to overlap the similar lever member 5. A raised reinforcing rib 19 of the lever member 5 extends beside the latching arm 8 and the actuation arm 10 to strengthen the lever member 5, latching arm 8 and the shoulder 9.

Figure 6:
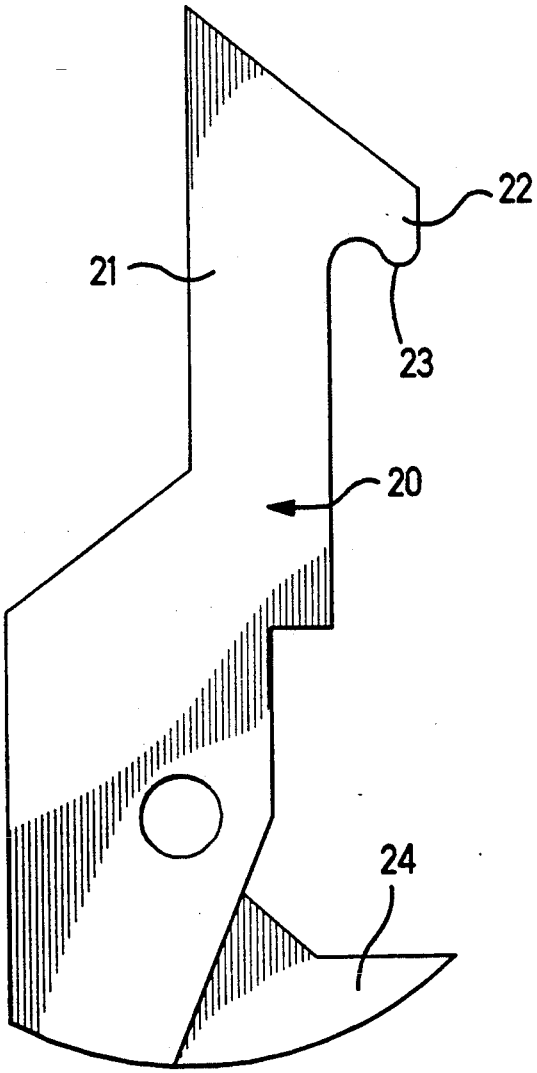
FIG. 6 PRIOR ART
FIG. 6 is a view of a known latch mechanism.

FIG. 6 represents a known latch mechanism 20 having a lever member 21 that is simply of narrow width to produce a desired clearance from another similar latch mechanism, not shown. The lever member 21 includes a latching arm 22 with a shoulder 23. An eject lever 24 is on the lever member 21.

I claim:

1. Pivoting latch mechanisms on respective ends of multiple headers, comprising:

the ends of the multiple headers being located such that the latch mechanisms pivot against one another; and the latch mechanisms comprising;

lever members in first positions engaging respective electrical devices in the headers, the lever members each being disengageable from the respective electrical devices by being pivoted fully to respective second positions, actuation arms on respective lever members, gripping surfaces on respective actuation arms to receive forces to pivot the respective lever members, each of the lever members in said first position having a recess received against the other lever member with said other lever member being pivoted fully to said second position, and with said other lever member being pivoted fully to the second position, the actuation arm thereon overlaps the actuation arm on said lever member in said first position.

2. Pivoting latch mechanisms as recited in claim 1, and further comprising: a latching arm on each of the lever members with a shoulder engaging the electrical device when the lever member is in said first position, and a reinforcing rib extending beside both the latching arm and the actuation arm.

3. Pivoting latch mechanisms as recited in claim 1, and further comprising: each of the lever members in said first position having a second recess receiving the actuation arm of said other lever member with said other lever member being pivoted fully to said second position.

4. Pivoting latch mechanisms as recited in claim 3, and further comprising: each actuation arm extending in an offset from the lever member such that a thickness of the actuation arm extends in an overhang beyond the thickness of the lever member.

* * * * *